United States Patent [19]

Nelson

[11] Patent Number: 4,505,013

[45] Date of Patent: Mar. 19, 1985

[54] PROCESS AND APPARATUS FOR MAKING COHERENT YARN

[75] Inventor: Thomas L. Nelson, Georgetown, Del.

[73] Assignee: E. I. Du Pont de Nemours and Company, Wilmington, Del.

[21] Appl. No.: 438,712

[22] Filed: Nov. 1, 1982

Related U.S. Application Data

[63] Continuation-in-part of Ser. No. 195,083, Oct. 30, 1980, abandoned.

[51] Int. Cl.[3] ..... D02J 1/08

[52] U.S. Cl. ..... 28/274

[58] Field of Search ..... 28/271, 274, 275, 276; 57/289

[56] References Cited

U.S. PATENT DOCUMENTS

| | | | |
|---|---|---|---|
| 3,204,319 | 9/1965 | Baer et al. | 28/274 X |
| 3,364,537 | 1/1968 | Bunting et al. . | |
| 3,389,444 | 6/1968 | Fletcher . | |
| 3,568,426 | 3/1971 | Whitley | 28/271 X |
| 3,742,695 | 7/1973 | Conrad | 57/289 |
| 3,781,949 | 1/1974 | Breen . | |
| 3,785,135 | 1/1974 | Seem et al. | 57/289 |
| 3,846,968 | 11/1974 | Sheehan . | |
| 3,944,166 | 3/1976 | Hermanns | 28/271 X |
| 4,055,040 | 10/1977 | Lin . | |
| 4,059,873 | 11/1977 | Nelson . | |
| 4,064,686 | 12/1977 | Whitted . | |
| 4,069,565 | 1/1978 | Negishi et al. . | |
| 4,070,815 | 1/1978 | Negishi . | |
| 4,074,511 | 2/1978 | Chambley et al. | 57/289 X |
| 4,138,840 | 2/1979 | Greenway et al. | 28/276 X |
| 4,157,606 | 6/1979 | Loew | 28/271 |

FOREIGN PATENT DOCUMENTS

| | | | |
|---|---|---|---|
| 554150 | 3/1958 | Canada . | |
| 45-14580 | 5/1970 | Japan | 28/271 |
| 6905673 | 3/1970 | Netherlands | 28/275 |
| 1204676 | 9/1970 | United Kingdom | 28/274 |
| 1239758 | 7/1971 | United Kingdom | 28/274 |

*Primary Examiner*—Robert R. Mackey

[57] ABSTRACT

An improved process (and apparatus) for intermingling filaments of a yarn or yarns with a fluid-jet device employs long narrow tubular guides to peripherally constrain vibrations in the yarn upstream, and optionally downstream, of the intermingling zone. The apparatus and process can be used with differentially dyeable bulked supply yarns to make a heather dyeable yarn for carpets.

15 Claims, 3 Drawing Figures

PROCESS AND APPARATUS FOR MAKING COHERENT YARN

CROSS-REFERENCE TO RELATED APPLICATION

This application is a continuation-in-part of my copending application Ser. No. 195,083 filed Oct. 30, 1980, now abandoned.

DESCRIPTION

1. Technical Field

The present invention relates to a process and apparatus involving a fluid-jet device for intermingling filaments in a continuous filament yarn or yarns, including combining a plurality of yarns to produce a larger coherent yarn. More particularly, the invention relates to a process and apparatus involving a tubular guide for guiding yarn which is being overfed into a fluid-jet filament intermingling device.

2. Background Art

Fluid-jet filament intermingling devices have long been used to make twist-free coherent yarns and also to combine a plurality of yarns into a single coherent yarn having the filaments of the various yarns intermingled with one another. See for example U.S. Pat. No. 3,364,537 (Bunting and Nelson). U.S. Pat. No. 4,069,565 (Negishi) concerns an apparatus and process for making a textured (bulked) multifilament yarn provided with compact portions and open portions alternately distributed along its length. For effective operation, in addition to being kept under controlled tension as taught in Bunting and Nelson, the threadline must be bent at points of contact both upstream and downstream of the intermingling zone.

U.S. Pat. No. 4,059,873 discloses a process for making a bulked continuous filament heather yarn by combining a plurality of crimped continuous filament yarns of different color and/or dye receptivity in a fluid intermingling zone from which the combined yarn is drawn at a rate less than the feed rate into the zone. The fluid flow not only intermingles the filaments but also forwards the resultant yarn from the intermingling zone. To separate the yarn from the escaping fluid, the yarn path is angled sharply with respect to the yarn passageway upon both entering and leaving the intermingling zone.

Objects of the present invention include an improved process (and apparatus) for making a coherent yarn, particularly from a bulked yarn or yarns, with a fluid jet device into which the yarns are to be overfed. Other objects include a more energy efficient process for combining yarns, particularly for making a bulked heather-dyeable carpet yarn, and an overfeeding process operable at high yarn speeds.

DISCLOSURE OF THE INVENTION

Figure 1:
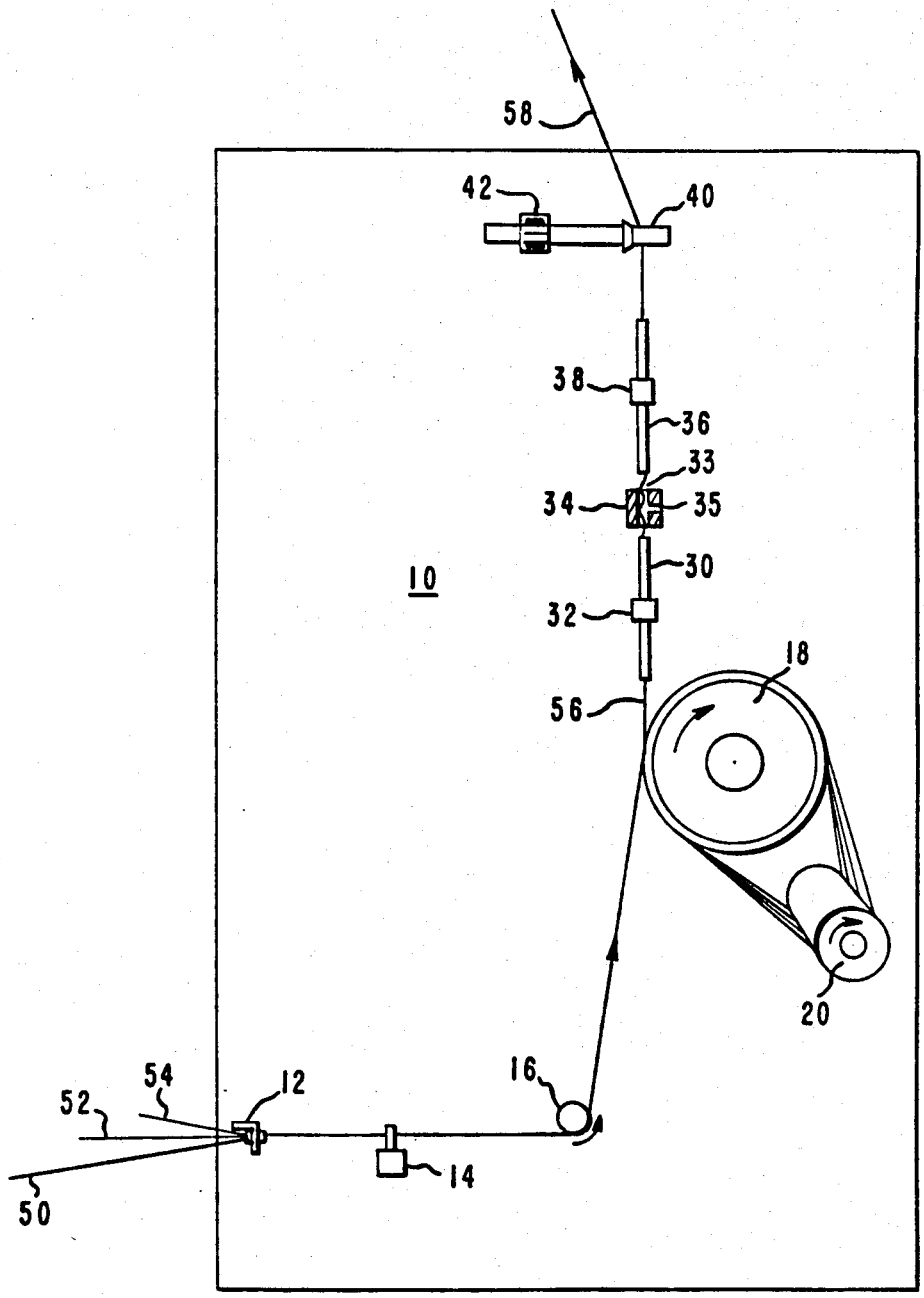
FIG. 1 is a schematic elevational view of an apparatus of the invention having a tubular yarn guide coaxially positioned upstream and also downstream of a fluid-jet filament intermingling device.

This invention provides a process for intermingling filaments of at least one continuous multifilament yarn by passing the yarn through a fluid-jet filament intermingling zone which includes an enclosed yarn passageway with a yarn entrance and a yarn exit and a substantially cylindrical form in between them, and in said passageway impinging at least one high velocity jet of compressible fluid upon said yarn to vibrate and to intermingle filaments thereof while allowing the fluid to escape the passageway through said yarn entrance and yarn exit, wherein the process comprises forwarding said yarn under a controlled speed to and withdrawing it in more coherent form from said zone at a controlled withdrawal speed of 2–15% less than the forwarding speed, said forwarding and withdrawing being along a path which is substantially coaxial with said passageway, and peripherally constraining lateral filament vibrations in said yarn being forwarded upstream of said zone and substantially separating the fluid escaping through said yarn entrance from the forwarded yarn by tubular confinement which extends from the beginning of said zone at a point proximate to said yarn entrance and continues along said path coaxially for a distance of at least three inches (7.62 cm.) upstream therefrom.

The invention is particularly beneficial when a single jet of compressible fluid having a cross-sectional area less than that of the yarn passageway is perpendicularly impinged in said passageway on said yarn or yarns, and particularly at yarn speeds above about 1500 ypm (1371 mpm).

The process is particularly effective and useful for combining a plurality of non-coherent or less coherent yarns into a single more coherent yarn of greater denier, i.e., doubling. A preferred application of such a process is for combining bulked yarns which are differentially dyeable with respect to one another for making mixed-colored yarns, such as marl or heather yarns, of almost any degree ranging from very bold to very fine. To make bulked heather yarns having a high degree of intermingling, it is preferred that the yarns entering the intermingling zone have a Coherency Factor of less than 6.0. Supply yarns with higher coherency result in less intermingling and bolder mixed-color effects.

The process requires using peripheral, such as tubular, confinement of the yarn upstream of the intermingling zone for a distance of three inches (7.62 cm.) or more. More improvement in performance and results can be obtained with a confinement distance of at least five inches (12.7 cm.). Best operability and yarn results have been obtained when the tubular confinement is continued upstream from the intermingling zone for a distance of at least 10 inches (25.4 cm.) where the yarn path permits such length. Such confinement can be achieved with guide member bores constructed in various ways, not necessarily as a thin or thick walled tube. Equivalent bores can be constructed for instance as an appropriately dimensioned groove in the side of a block or plate which is covered by another flat surfaced block or plate, or by one with a matching groove.

The exit end of the bore must be proximate to, i.e., near but yet spaced from, the yarn entrance to the passageway. This permits fluid to escape from the passageway without being forced up the bore. Otherwise increased back pressure on the fluid in the passageway significantly reduces the turbulence, and consequently the intermingling; thus, producing an effect quite the opposite to that desired, i.e., improved or more efficient intermingling. The spacing can be radial in direction as well as longitudinal, such as with a thin-walled tube having an outer diameter substantially smaller than the diameter of the yarn passageway; in which case the end of the tube (and bore) can be positioned slightly inside the passageway but it must not substantially block it or make the intermingling zone within the passageway too short to be effective. Appropriate spacings and dimensions can be readily determined by reference to the Examples herein and by one skilled in the art, depending upon the chosen variables of yarn denier, yarn processing speed, fluid pressure available, jet design, and so forth.

To facilitate filament intermingling, it is necessary that the yarn be withdrawn from said zone at a speed that is from 2 to 15% less than the speed at which it is forwarded to said zone, preferably from 5 to 15% less and especially when bulked yarns are fed directly from a zone in which the filaments of the supply yarn or yarns are under tension.

Under certain circumstances, operability and yarn appearance can be further improved by peripherally constraining the yarn as it is withdrawn from the intermingling zone (i.e., by tubular confinement downstream from said zone in a manner comparable to the upstream tubular confinement). This additional confinement is applicable, for example, to supply yarns with low finish, for instance, which have been dyed and consequently contain less than about 0.3% by weight of a yarn finish.

This invention also provides an apparatus for intermingling filaments of at least one continuous multifilament yarn which comprises a fluid-jet filament intermingling body member, a substantially cylindrical yarn passageway through said body member having a yarn entrance end and a yarn exit end, at least one fluid conduit leading into said passageway through said body member having an axis which intersects the longitudinal axis of said passageway, means for supplying compressible fluid under high pressure to said conduit, means for forwarding at least one yarn at a controlled speed to the entrance end of said passageway, means for withdrawing intermingled yarn from said yarn exit end at a controlled speed from 2 to 15% less than the forwarding speed, a yarn guide positioned between said means for forwarding yarn and said yarn entrance end which guide defines a straight yarn path between said guide and said yarn entrance end which path is coaxial with said passageway, said guide consisting essentially of a guide member, such as a tube, having a longitudinal bore substantially coaxially aligned with said passageway and positioned along a straight line path between said means for forwarding yarn and said passageway entrance end, said bore having a diameter less than the diameter of said passageway but large enough to allow free passage of said yarn or yarns through said bore while peripherally constraining lateral filament vibrations and lateral yarn movement in said bore, said bore having an exit end located proximate to but separated from said yarn passageway entrance end and having a length of at least 3 inches (7.62 cm.).

The bore preferably has a length of at least 5 inches (12.7 cm.) and more preferably at least 10 inches (25.4 cm.) in accordance with the above described process.

Normally the ratio of the diameter of said passageway to said bore should be at least about 1.3:1.0, preferably no greater than about 4.0:1.0. The apparatus is particularly effective when the exit end of the upstream tube is longitudinally spaced upstream from the entrance end of said passageway within the range of about 0.125 to 0.50 inches (0.32 to 1.27 cm.).

For bulked yarns of conventional carpet deniers, i.e., 1,000 to 15,000 denier, effective bore diameters for the tube are within the range of about 0.06 to 0.25 inch (1.52 to 6.35 mm.).

The apparatus can include a guide member with a bore, such as a tube, of comparable dimensions and relative spacing positioned between said yarn passageway exit end and said withdrawing means coaxially along said yarn path.

Applying water to the yarn prior to intermingling improves operability and the intermingling effectiveness of the process. Water application devices are known in the art for such purposes. The water should be applied at a rate to provide from about 5 to about 25 percent by weight of the yarn, but the amount is not critical.

Regarding the Figures in greater detail, FIG. 1 depicts an apparatus of the invention being used to combine three bulked multifilament supply yarns into a single coherent bulked heather-dyeable yarn. The apparatus includes a machine face plate 10 on which are mounted a yarn guide 12 followed by a water application device 14, change of direction roll 16, a means for forwarding yarn at a controlled speed consisting of a pair of driven rolls, roll 18 and its associated canted roll 20. Then upstream tube guide 30 and optional downstream tube guide 36 (bores thereof not shown) are held in coaxial alignment, by brackets 32 and 38 respectively, with cylindrical yarn passageway 33 in jet body member 34. Body member 34 is shown in cross-section to reveal passageway 33 which is perpendicularly intersected by smaller fluid conduit 35. Fluid conduit 35 is supplied with a compressible fluid under pressure from a source (not shown). The space between tube guides 30 and 36 determines the length of the intermingling zone produced by the action of the fluid jet device. Means for withdrawing the intermingled yarn from the intermingling zone at a speed 2–15% less than the forwarding speed consists of take-away idler roll 40 combined with a coner roll (not shown) or other suitable roll and windup arrangement. Roll 40 is held in position by bracket 42 so as to define a straight yarn path from roll 18 to roll 40 which is coaxial with tubes 30, 36 and with passageway 33.

As shown in FIG. 1, differentially-dyeable, bulked, multifilament supply yarns 50, 52, 54 from separate packages held on a creel (not shown) are pulled by rolls, 18, 20 through guide 12 and water application device 14, around roll 16, and then are forwarded in a converged contiguous state into the upstream end of tube 30, through body member 34 and tube guide 36. They are withdrawn by take-away roll 40 as an intermingled heather-dyeable coherent bulked yarn 58.

Figure 2:
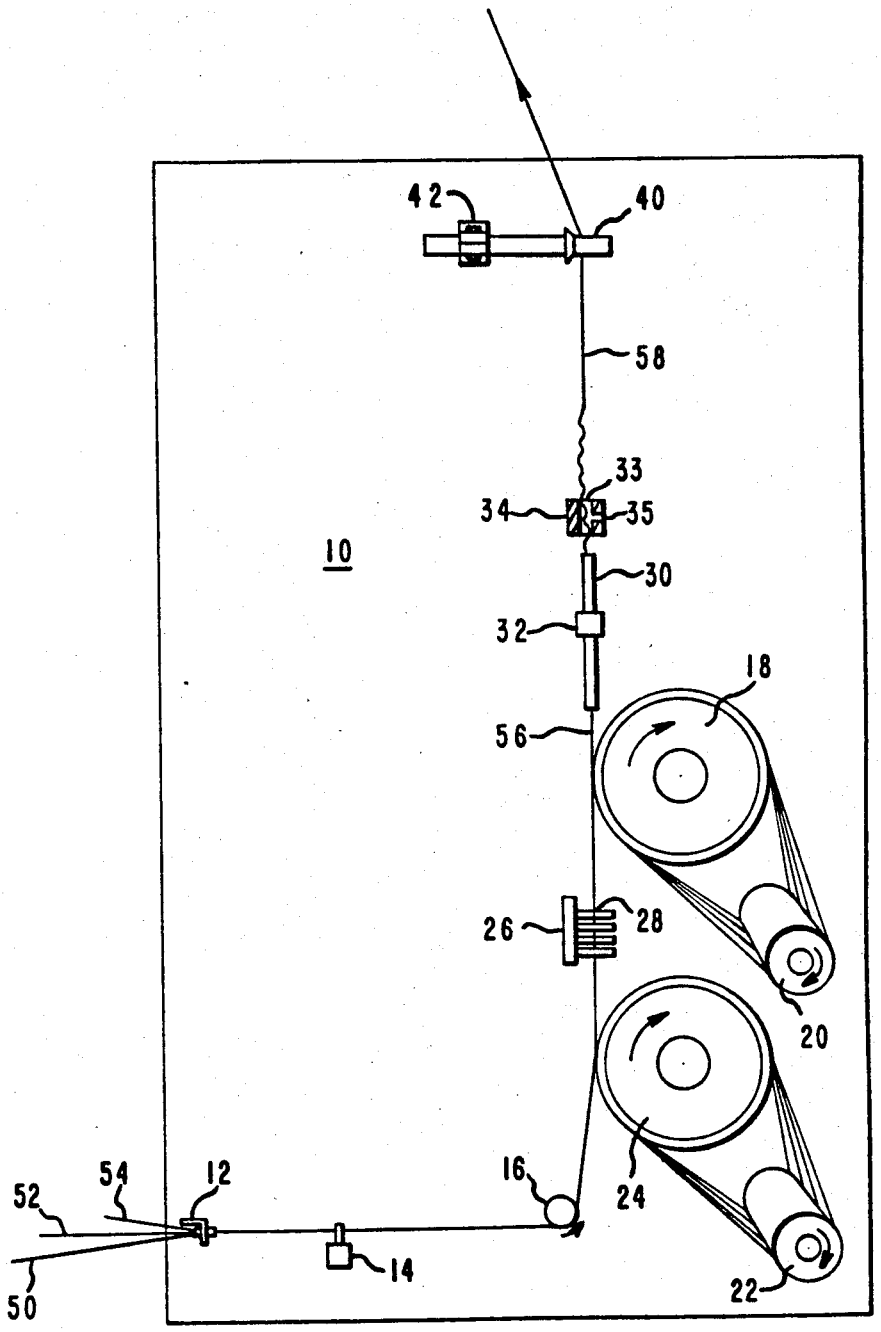
FIG. 2 is a schematic elevational view of a preferred apparatus of the invention having a tubular yarn guide upstream only of the jet device and which is preceded by a tensioning zone and snubbing pins for removing filament entanglement from the supply yarns.

The apparatus depicted in FIG. 2 is the same as that in FIG. 1 but modified by the deletion of optional downstream tube guide 36 and by the addition of driven tensioning roll 24 and its associated canted roll 22 along with parallel snubbing pins 28 mounted in a base 26 for disentangling filaments of the supply yarns prior to being intermingled.

Figure 3:
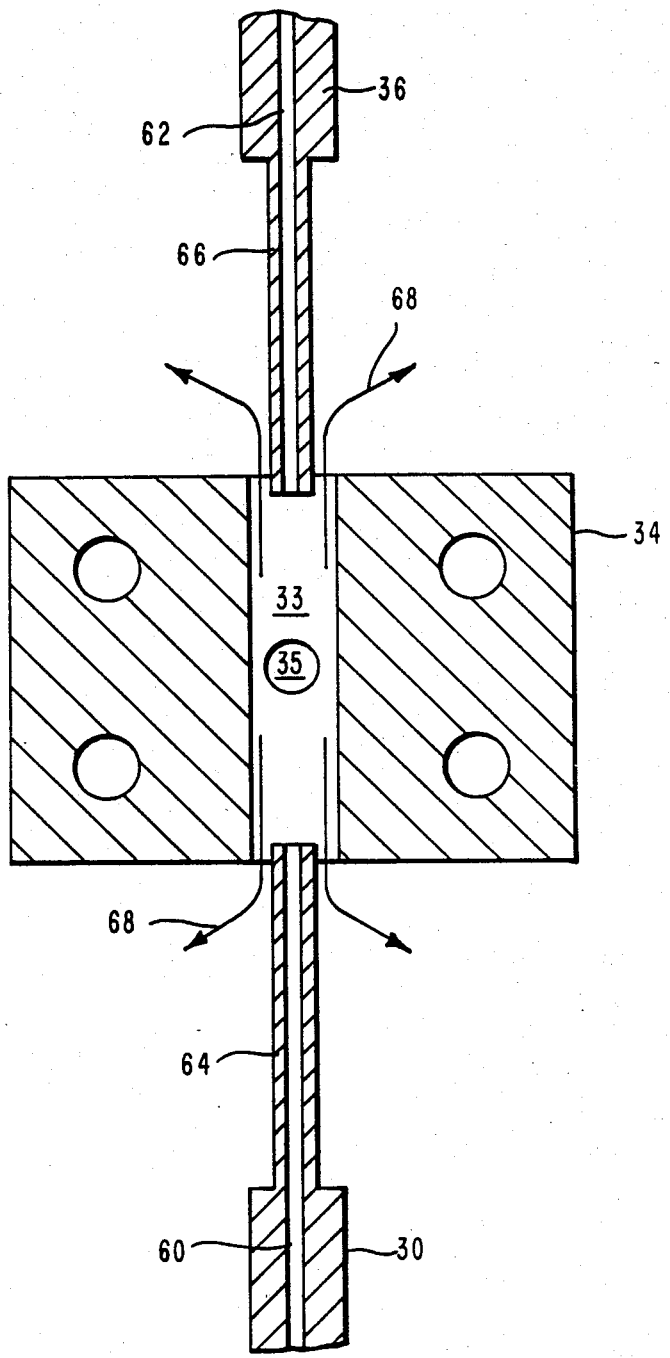
FIG. 3 is a schematic cross-sectional representational view of a fluid-jet intermingling device with tubular yarn entry and exit guides suitable for use in the invention.

FIG. 3 shows in cross section a jet body member 34 of the same type as in FIG. 1 having a yarn passageway 33 and a fluid conduit 35. Associated with body member 34 according to the invention are upstream and downstream tube guides, 30 and 36, respectively, having bores 60, 62 and thin-walled tube ends 64, 66, respectively. Tube ends 64, 66 terminate proximate to, but slightly within the corresponding ends of yarn passageway 33 allowing the jet fluid to escape from the passageway as represented by flow routes 68.

The tubular guides stabilize the yarn while still allowing the fluid to escape from the ends of the passageway thus allowing more efficient intermingling by the jet in the intermingling zone. Also the formation of single filament loops caused when "out-of-position" filaments are locked in place by the entangling action are minimized. If desired, the entrance to the yarn passageway can be constricted slightly, for example either by an eccentric yarn gate of the type shown in FIG. 2 of U.S. Pat. No. 4,059,873 (Nelson) or by a concentric constriction such as a smaller diameter hole in a metal plate placed against the entrance to the yarn passageway; but such constriction tends to reduce the effectiveness of the intermingling zone resulting in less entanglement in the nodal regions. Where entanglement is more than adequate, such a constriction can be used to provide a slight jet forwarding action to the yarn as it exits the intermingling zone or to make a more uniform less nodal structure along the yarn.

Supply yarns for use in this invention can be compact or bulked. Bulked supply yarns are preferably those which have been bulked by a hot fluid jet-bulking process, for example of the type in U.S. Pat. No. 3,781,949 (Breen et al.). Such yarns have superior bulk and normally have some coherency due to intermingling of the filaments; but this intermingling is usually only among a part of the filaments at any location along the yarn and seldomly among all filaments at a given location. Therefore when two or more of these yarns are combined by this invention without first removing this intermingling, the filament bundles open to a limited extent so that the filaments of different yarns can intermingle to some degree; but if the resulting yarn is then cross-dyed, the yarn will appear mostly as a bold mixture of the individual yarn colors with little blending of colors. When this coherency is removed by tensioning and snubbing the supply yarns before being intermingled together, the filaments of the yarns are then able to open and intermingle more freely and frequently, producing more zones of blended colors.

The term "bulked" as used herein refers to yarns of permanently crimped filaments, that is the filaments retain their crimp upon removal from the yarn.

The term "differentially dyeable" refers to yarns which can be cross-dyed in a common dye bath to different colors or shades of color. The term also includes differentially colored yarns since such yarns upon dyeing, even with a common dye, will inherently remain differentially "dyed", i.e., differently colored.

The Coherency Factor test of filament intermingling in a yarn used herein is determined in the known way by clamping a sample of yarn in a vertical position under the tension provided by a weight in grams which is 0.20 times the yarn denier but not greater than 100 grams. A weighted hook, having a total weight in grams numerically equal to the average denier per filament of the yarn but weighing no more than 10 grams, is inserted through the yarn bundle and lowered at a rate of 1 to 2 cm./sec. until the weight of the hook is supported by the yarn. The distance which the hook has travelled along the yarn until the weight is supported characterizes the extent of filament intermingling in the yarn. The result is expressed as a "Coherency Factor" which is defined as 100 divided by the above travelled distance in centimeters. Since filament intermingling is random, a sufficiently large number of samples are tested to define a representative average value for the test yarn.

For more highly intermingled heavy denier yarns, such as carpet yarns produced by this invention, the Lateral Pull-apart Test provides a more discriminating measure of yarn coherency. For this known test, two hooks are placed at a randomly selected point in about the center of the sample yarn bundle to separate it into two groups of filaments. The hooks are pulled apart at a rate of 5 inches per minute (12.7 cm. per minute) at a 90° angle to the yarn axis by a tensile testing machine which measures the resistance to separation of the hooks, such as an "Instron" machine. The yarn is pulled by the hooks until a 1-lb (454 gm.) force is exerted, at which point the machine is stopped and the distance between the two hooks is measured and recorded. Ten determinations are made for each yarn and the average taken as the pull-apart value. The test yarn sample length should be at least 4–6 inches (10–15 cm.) long and selected randomly from throughout the yarn package to be tested.

EXAMPLE 1

This example demonstrates the significance of tube guides in the apparatus and process of the invention using bulked supply yarns already having a moderate amount of filament intermingling (yarn coherency) as commonly provided in bulked continuous filament nylon yarns intended for commercial use as direct-tufting carpet yarns. Such yarns commonly have a Coherency Factor in the range of from about 25 to about 50.

The apparatus and process correspond to those described in FIG. 1.

The jet device body member has a yarn passageway 1.000±0.001 inch (2.540 cm.) long with a constant diameter of 0.228±0.001 inch (0.58 cm.) which is perpendicularly intersected at its mid-point by a cylindrical fluid conduit with a diameter of 0.125±0.001 inch (0.32 cm.). The center line of the conduit intersects within 0.001 inch (0.00254 cm.) of the center line of the passageway. The edges of the yarn entrance and exit ends of the passageway are smoothed by rounding to a 0.03 inch (0.76 mm.) radius.

The jet device is manufactured from a Type 416 stainless steel block which is 1.500 inches wide (3.81 cm.) by 1.000 inch high (2.540 cm.) by 1.125 inch deep (2.86 cm.). The passageway runs through the block perpendicularly from top to bottom and is centered between each end thereof. Its center line is positioned 0.500 inch (1.27 cm.) from the front of the block and the conduit enters from the rear of the block. The body member is adapted to be bolted to a manifold for supplying the conduit with air under pressure.

The conduit is supplied with air at 150 psig (10.5 kg/cm.$^2$) which flows through it at a rate of 36 scfm (1.02 cu. meters/min) at ambient temperature.

Forwarding rolls 18, 20 operate to supply the yarns at 1,000 ypm (914 meter/m.). The yarns make at least eight yarn wraps around the rolls to assure a consistent feed rate. Water is applied by the water application device 14 to the yarns at 1.0 gal./hr. (3.79 liter/hr.). The speed of a take-up coner roll is adjusted to provide a 3% yarn overfeed to it from the forwarding rolls.

A piece of commercial seamless stainless steel tubing with a bore diameter of 0.084 inch (2.13 mm.) and 11.0 inch (27.9 cm.) long, for peripherally constraining lateral vibrations in the yarn upstream of the jet, is coaxially aligned with the yarn passageway and positioned with a ¼ inch (0.64 cm.) clearance between its exit end and the entrance to the yarn passageway. The entrance end of the tube is about 5.5 inches (13.97 cm.) from where the supply yarns leave the surface of the forwarding roll on their way to the jet device.

Runs are made using this apparatus with three supply yarns for each of the following items:

(A) The supply yarns are each 1225 denier. They are commercial (Du Pont) nylon bulked continuous filament yarns prepared by a hot fluid jet screen-bulking process. The yarns are differentially dyeable—one being cationically dyeable (Type 854), one light-acid dyeable (Type 855), and one being deep acid dyeable (Type 857). The yarns contain a conventional producer spin finish within the standards of 0.7% mean finish on yarn and package limits within the range of 0.4 to 1.35% finish on yarn.

The three yarns are made into a single coherent yarn under the above conditions. Visual examination of cross-dyed skeins shows a periodic nodal interlace structure with a sizable amount of filament intermingling (in spite of the intermingling already present in each of the supply yarns). The yarn gives a pull-apart value of about 1.25 in. (3.18 cm.).

Another yarn is prepared from the same three supply yarns under the same conditions but with the addition of a tube guide of the same dimensions as above coaxially aligned downstream of the jet yarn passageway with a ¼ in. (0.64 cm.) clearance between the passageway exit and the entrance to the downstream guide tube. Visual examination of cross-dyed skeins of the resulting yarn as well as pull-apart coherency values show that the yarn is substantially the same as when made without the downstream tube.

(B) Using the same process conditions as in (A) three ends of space-dyed 1820T-497 bulked continuous filament nylon yarn are entangled to make a single coherent yarn. The yarns have been randomly space-dyed which provides a mottled beige/brown appearance on the wound supply packages. Because of the dyeing, producer spin finish on the yarn has been reduced to about 0.25% by weight. Yarn made using both upstream and downstream tube guides as above shows a desirable periodic interlace structure regularly along the yarn resulting in a pull-apart value of 1.6 in. (4.06 cm.). Under the same conditions except with no water applied to the yarn only a low level of intermingling is realized which is not subject to meaningful pull-apart testing. A third test is made using the upstream tube guide only, with water application. The resulting yarn shows a less desirable nodal interlace structure randomly spaced along the yarn with an average pull-apart value of 2.3 in. (5.84 cm.). From this it is concluded that for entangling supply yarns having low yarn finish levels, such as 0.3%, best results are obtained with water applied and using tube guides both upstream and downstream of the jet device.

EXAMPLE 2

This example shows the effectiveness of tube guides with the same supply yarns and conditions as in Example 1A except that the moderate coherency in the supply yarns (C.F. 25–50) is first removed from each yarn to provide a Coherency Factor of less than 6.0. This is achieved by disentangling the filaments under tension with the aid of a series of parallel snubbing pins using apparatus as represented in FIG. 2. Four steel snubbing pins 0.25 in. (6.35 mm.) in diameter are used. They are spaced with their centers about 0.5 in. (1.27 cm.) apart. The speed of the tension rolls (24, 22) is adjusted to provide a tension on the yarns between them and the forwarding rolls of about 1.2 gpd. Use of these low cohesion supply yarns allows the overfeed to be increased to 10% between the forwarding rolls and the take-away roll. Cross-dyed skeins of yarn produced in this manner show a desirable regular periodic interlace node structure separated by sections of highly blended filaments. A pull-apart test gives the value of 0.9 in. (2.29 cm.).

This process is repeated under the same conditions except that no water is applied to the yarn with the water applicator. The product again is a highly blended, highly entangled yarn with a pull-apart of 1.0 in. (2.54 cm.), but the periodic highly entangled regions are less dense than before. Therefore, under these conditions water application is not required to obtain a good product.

The process (using water) is repeated except that the speed of the supply yarn is increased to 2,000 ypm (1,828 mpm) and the overfeed is increased to 12%. Cross-dyed skeins of yarn prepared in this manner show a marked difference in entanglement structure as compared to that produced at the lower speed. The periodic nodal interlace structure of the lower speed yarn is replaced by a randomly blended filament bundle character of more uniform density along the yarn. The level of filament blending is very good considering the high yarn speed and relatively low flow of air in the jet (36 scfm, 1.02 cu.meters/min.).

From these tests it is concluded that standard commercial bulked continuous filament supply yarns containing normal amounts of spin finish (i.e., at least about 0.75%) require only an upstream guide tube for effective operation.

Similar results are obtained in a test series using guide tube bore diameters of 0.060 in. (1.52 mm.), 0.120 in. (3.05 mm.) and 0.152 in. (3.86 mm.) in lengths of 6 in. (15.24 cm.) and 11 in. (27.94 cm.). Little difference in color blending and entanglement level is found throughout the series. A ¼ in. (6.35 mm.) clearance between the guide tube end and the entrance to the yarn passageway is maintained for each tube size. Conditions were otherwise held substantially constant.

EXAMPLE 3

This example substantially repeats the first run of Example 2 under the following conditions. The supply yarns are the same and the apparatus is again as represented in FIG. 2. The forwarding roll speed is 1119 ypm (1023 mpm). The supply yarns are disentangled to a Coherency Factor of less than 6.0 under a tension of 1.14 gpd. A single guide tube is used upstream of the jet having a length of 11 in. (27.94 cm.) with a bore diameter of 0.152 in. (3.86 mm.). Its downstream end is spaced ¼ in. (6.35 mm.) from the yarn passageway entrance. The jet is of the same design as in Example 2 except that the diameter of the fluid conduit is 0.156 in. (3.96 mm.). The fluid conduit is supplied with air at a pressure of 75 psig at 25° C. which provides a flow rate of 23 scfm (0.64 $m^3$/min.). A 3-slot water applicator is used at a flow rate of 1.0 gal/hr. (3.79 liters/hr.). A coner roll controls the take-away speed at 1,007 ypm (920 mpm) giving an overfeed of 11%. The coherent yarn product is wound into a package under a winding tension of 225 grams. These conditions provide a product throughput of 56 lbs/position/hr. (25.4 kilograms).

In spite of the lower air pressure used in this process versus Example 2, dyed knit fabric of the yarn shows the yarn to be more highly blended than a control yarn prepared under similar conditions but at a much higher air pressure and flow using the process and apparatus of U.S. Pat. No. 4,059,873.

EXAMPLE 4

This example demonstrates the effects of guide tube length on the operating performance and yarn appearance under the process conditions of Example 3.

Identical runs are made except that tubes are tested having lengths of 1 inch (2.54 cm.), 3 inches (7.62 cm.), 5 inches (12.7 cm.), and 11 inches (27.94 cm.) as well as a textile yarn guide ¼ inch (0.64 cm.) long and no guide at all between the forwarding rolls and the yarn passageway.

Operating performance is best for the 11 inch (27.94 cm.) tube. Yarns entering the shorter tubes show an unstable vibratory action which is particularly noticeable with the 3 inch (7.62 cm.) and 5 inch (12.7 cm.) tubes.

Cross-dyed skeins of the yarns are evaluated for appearance. A tube length of at least 3 inches (7.62 cm.) is seen required to produce a uniform, well-intermingled yarn. Shorter tubes as well as no tube produce yarns with less intermingling and a less uniform distribution of nodes.

Based on both operating performance and yarn appearance, the preferred tube length is concluded to be at least 5 inches (12.7 cm.).

EXAMPLE 5

This example demonstrates the use of the invention to make a very high denier heather yarn for carpets.

The apparatus is as shown in FIG. 2 using the snub pins to disentangle the supply yarns to a Coherency Factor of less than 6.0. Three types of commercial hot fluid jet bulked continuous filament 66-nylon yarns are combined into a single yarn using two ends of each yarn type (six yarns in all). The types are a cationic 1225 denier (Type 494) mid-dull yarn, a 1225 denier light acid dyeable (Type 495) mid-dull yarn and a 2470 denier deep acid dyeable (Type 497A) mid-dull yarn. The jet body construction is as in the preceding examples except the diameter of the passageway is 0.312 inch (0.79 cm.) and the air conduit has a diameter of 0.213 inch (0.54 cm.). The conduit is supplied with air at 100 psig (7 kg./$cm^2$) at a flow rate of 40 scfm (1.12 $m.^3$/min.). The forwarding speed is 455 ypm (416 mpm) and water is applied at a flow rate of 2.0 gal./hr. (7.57 liters/hr.). The single upstream guide tube is 11 inches (27.94 cm.) long with a bore 0.152 in. (0.39 cm.) in diameter. Its exit end is spaced ¼ in. (0.64 cm.) from the passageway entrance. The yarn withdrawal speed is controlled by a coner roll at 412 ypm (377 mpm) to give an overfeed of 10%. The resulting yarn has a total denier of 10400 and a periodic nodal interlace structure with a sizable amount of filament intermingling among the component yarns. A cross-dyed carpet of the yarn has a nondirectional heather appearance with the deep-dyed component yarn predominating.

EXAMPLE 6

This example demonstrates use of the invention for doubling compact (non-bulked) yarns to make a coherent compact yarn of heavier denier.

The supply yarns consist of three ends of a drawn 1,000 denier 68 filament zero-twist flat 66-nylon yarn which has not been interlaced and is substantially free of filament entanglement. The yarn contains 0.8% of a conventional yarn finish.

The apparatus is the same as in Example 3 except that the tensioning rolls and snub pins are not used since the supply yarns are already substantially free of filament entanglement.

The compressible fluid is air at 100 psig (7 kg./$cm.^2$) and the flow rate is 30 scfm (0.84 $m.^3$/min.). A winding tension of 200 grams is used and the resulting yarns have a denier of about 3100.

Runs are made at two different overfeeds, each with and without the single tube guide preceding the intermingling zone. The process conditions are otherwise the same as in Example 3. The results are as follows:

| | With Tube | | Without Tube | |
|---|---|---|---|---|
| % Overfeed | 2.1 | 7.6 | 2.1 | 7.2 |
| Pull Apart, In. | 1.40 | 1.23 | 2.33 | 2.82 |
| (cm.) | (3.56) | (3.12) | (5.92) | (7.16) |

It is apparent from these results that the tube guide significantly improves the filament entangling effectiveness of the intermingling zone.

EXAMPLE 7

This example demonstrates the use of thin-walled guide tubes which allow them to be inserted for a short distance into the yarn passageway while still allowing ample clearance for fluid exhaust flow as represented by FIG. 3.

A guide tube arrangement substantially as represented by FIG. 1 and as used in Example 1 is used except that the guide tubes are modified by securing 14 gauge hypodermic tubing (0.083 inch outside diameter by 0.063 inch inside diameter) in the stainless steel tubing of Example 1 and allowing it to extend approximately 1.5 inch beyond one end. The jet device is the same as described in Example 1 except that the fluid conduit has a diameter of 0.128 inch. The diameter of the yarn passageway is the same, 0.228 inch, which allows ample clearance with respect to the 0.083 inch outer diameter of the hypodermic tubing. The upstream tube is 11 inches long and the downstream tube is 6 inches long. The ends of each are inserted one-eighth inch inside the corresponding ends of the yarn passageway. Two commercial nylon continuous filament feed yarns are used which have been bulked in a conventional hot fluid jet screen-bulking process. The yarns are differentially dyeable, one being a 1225 denier cationically dyeable yarn and the other being a 1225 denier deep acid dyeable yarn containing a 20 denier 3-filament sheath-core antistatic yarn. Water is applied to the yarns at the rate of 1.0 gallons per hour using a feed roll speed of 1119 yards per minute and a tension to reduce filament entanglement in the feed yarns (as described in Example 2) of 1.05 gpd. Air is supplied to the jet device under 75 psig at a rate of 17 scfm and a temperature of 25° C. The coner roll controls the yarn withdrawal speed at 1010 yards per minute to provide an overfeed of 10.8% in the intermingling zone.

Another yarn is prepared in the same manner using the stainless steel tubes without the hypodermic tubing inserts. The upstream tube is 11 inches long and has a bore diameter of 0.055 inch. The end of the tube adjacent the yarn passageway entrance is ¼ inch upstream thereof. A downstream tube is used which is 6 inches long, has a bore diameter of 0.067 inch with its entrance separated downstream from the end of the yarn passageway by ¼ inch.

Carpets are prepared by direct tufting from each yarn and cross-dyed for evaluation of the quality and uniformity of intermingling of the differentially dyeable yarns. Visual examination of the two yarns revealed no significant differences. Coherency as measured by pull-apart data is found to be 1.40 inch for the control tube test and 1.50 inch for the modified tube yarn. Banded carpets prepared to evaluate the two yarns side-by-side show both bands to be commercially acceptable in color uniformity. A panel of evaluators agreed that the band of carpet from yarn prepared using the modified thin-walled guides showed improved color uniformity versus the other yarn, however both yarns are observed to be commercially acceptable in color quality.

I claim:

1. A process for intermingling filaments of a least one continuous multifilament yarn by passing the yarn through a fluid-jet filament intermingling zone which includes an enclosed passageway with a yarn entrance and a yarn exit and a substantially cylindrical form in between them, and in said passageway impinging at least one high velocity jet of compressible fluid under high pressure, which intersects the longitudinal axis of the passageway, upon said yarn to vibrate and to intermingle filaments thereof while allowing the fluid to escape the passageway through said yarn entrance and yarn exit, wherein the process comprises forwarding said yarn under a controlled speed to and withdrawing it in more coherent form from said zone at a controlled withdrawal speed of 2–15% less than the forwarding speed, said forwarding and withdrawing being along a path which is substantially coaxial with said passageway, and peripherally constraining lateral filament vibrations in said yarn being forwarded upstream of said zone and substantially separating the fluid escaping through said yarn entrance from the forwarded yarn, both by tubular confinement which extends from the beginning of said zone at a point proximate to said yarn entrance and continues along said path coaxially for a distance of at least three inches upstream therefrom thereby reducing such pressure on the fluid in the passageway to increase turbulence and consequently the degree of intermingling of the filaments.

2. A process of claim 1 wherein a single jet of compressible fluid is impinged on at least two yarns in said passageway from a direction perpendicular to the longitudinal axis of said passageway.

3. A process of claim 3 wherein at least 2 yarns of said plurality are bulked yarns and differentially dyeable with respect to one another.

4. A process of claim 3 wherein the tubular confinement is continued upstream from said point for a distance of at least 10 inches.

5. A process of claim 3 wherein said yarns are forwarded into said passageway at a speed of at least 1500 ypm.

6. A process of claim 3 wherein the intermingled yarn downstream from the exit of said passageway is peripherally constrained by tubular confinement from a point proximate to said exit and continuing for a substantial distance downstream therefrom.

7. A process of claim 6 wherein the plurality of yarns contain a textile finish-on-yarn of less than about 0.3% by weight.

8. An apparatus for intermingling filaments of a least one continuous multifilament yarn which comprises a fluid-jet filament intermingling body member, a substantially cylindrical yarn passageway through said body member having a yarn entrance end and a yarn exit end, at least one fluid conduit leading into said passageway through said body member having an axis which intersects the longitudinal axis of said passageway, means for supplying compressible fluid under high pressure to said conduit, means for forwarding at least one yarn at a controlled speed to the entrance of said passageway, means for withdrawing intermingled yarn from said yarn exit end at a controlled speed from 2 to 15% less than the forwarding speed, a yarn guide positioned between said means for forwarding yarn and said yarn entrance end which guide defines a straight yarn path between said guide and said yarn entrance end which path is coaxial with said passageway, said guide consisting essentially of a tube having a longitudinal bore substantially coaxially aligned with said passageway and positioned along a straight line path between said mean for forwarding yarn and said yarn entrance end, said bore having a diameter substantially less than the diameter of said passageway but large enough to allow free passage of said yarn through said bore while peripherally constraining lateral filament vibrations and lateral yarn movement in said bore, said bore having an exit end located proximate to but separated from said passageway entrance end and a length of at least 3 inches whereby fluid escaping form the yarn entrance is separated from the forwarded yarn thereby reducing such pressure in the passageway to increase turbulence and consequently the degree of intermingling of the filaments.

9. An apparatus of claim 8 having a single fluid conduit which intersects said passageway perpendicularly and which has a cross-sectional area substantially less than that of said passageway.

10. An apparatus of claim 9 wherein said bore is at least 10 inches long.

11. An apparatus of claim 9 wherein the ratio of the diameter of said passageway to said bore is at least about 1.3:1.0.

12. An apparatus of claim 9 wherein the exit end of said bore is longitudinally spaced upstream from the entrance end of said passageway within the range of about 0.125 to 0.5 inches.

13. An apparatus of claim 9 wherein said bore diameter is within the range of about 0.060 to 0.250 inch.

14. An apparatus of claim 9 wherein said means for forwarding a yarn operates at a forwarding speed of at least 1500 ypm.

15. An apparatus of claim 9 including a second tube for guiding yarn positioned along said yarn path between said passageway exit end and said means for withdrawing yarn, said second tube also having a bore coaxial with said passageway and with said yarn path, said bore having a diameter less than the diameter of said passageway but sufficient to allow free passage of said bulked intermingled yarn while peripherally constraining lateral yarn and filament movement therein and having a yarn entry end positioned proximate to said passageway exit.

* * * * *